United States Patent [19]

Tojo et al.

[11] Patent Number: 4,861,245

[45] Date of Patent: Aug. 29, 1989

[54] SCROLL COMPRESSOR WITH SEALED PRESSURE SPACE BIASING THE ORBITING SCROLL MEMBER

[75] Inventors: Kenji Tojo, Chiyoda; Kenichi Kawashima, Katsuta; Kazutaka Suefuji, Shimizu; Yozo Nakamura, Chiyoda, all of Japan

[73] Assignee: Hitachi, Ltd., Tokyo, Japan

[21] Appl. No.: 85,754

[22] Filed: Aug. 17, 1987

[30] Foreign Application Priority Data

Aug. 22, 1986 [JP] Japan ..... 61-196643

[51] Int. Cl.[4] ..... F04C 18/04; F04C 27/00

[52] U.S. Cl. ..... 418/55; 418/57

[58] Field of Search ..... 418/55, 57

[56] References Cited

U.S. PATENT DOCUMENTS

| | | | |
|---|---|---|---|
| 4,065,279 | 12/1977 | McCullough | 418/55 |
| 4,365,941 | 12/1982 | Tojo et al. | 418/55 |
| 4,466,784 | 8/1984 | Hiraga | 418/55 |
| 4,475,874 | 10/1984 | Sato | 418/55 |
| 4,522,575 | 6/1985 | Tischer et al. | 418/57 |
| 4,552,518 | 11/1985 | Utter | 418/55 |

FOREIGN PATENT DOCUMENTS

| | | | |
|---|---|---|---|
| 55-148994 | 11/1980 | Japan . | |
| 57-28890 | 2/1982 | Japan | 418/55 |
| 57-148087 | 9/1982 | Japan . | |
| 60-166781 | 8/1985 | Japan | 418/57 |
| 60-224987 | 11/1985 | Japan | 418/57 |
| 60-224988 | 11/1985 | Japan | 418/57 |

*Primary Examiner*—John J. Vrablik

*Attorney, Agent, or Firm*—Antonelli, Terry & Wands

[57] ABSTRACT

A scroll compressor comprises two scroll members, each of which has an end plate and a wrap formed on the end plate so as to extend perpendicularly therefrom, are meshed with each other, one scroll member being orbited with respect to the other without being self-revolved, to introduce a gas into working chamber. The working chamber is formed by these two scroll members, compresses the gas therein and then discharge the same to the outside. A seal mechanism for pressure-sealing between the working chamber or the suction side and a space on a rear surface of the orbiting scroll member is provided on the same rear surface, and also a pair of small-diameter ports for communicating the mentioned space and working chamber with each other are provided on the end plate of the above-mentioned scroll member, whereby the outer diameter of the scroll members can be minimized, and the axial opposed end surfaces of the two scroll members can be maintained in sealed condition.

11 Claims, 4 Drawing Sheets

SCROLL COMPRESSOR WITH SEALED PRESSURE SPACE BIASING THE ORBITING SCROLL MEMBER

BACKGROUND OF THE INVENTION

This invention relates to a scroll compressor suitable to the use thereof as a compressor for a room air conditioner and a car air conditioner.

In a conventional scroll compressor, the outer peripheral portion of an orbiting scroll member is held between a stationary scroll member and a stationary member, and a space formed on the rear surface of an end plate of the orbiting scroll member and a working chamber having an internal pressure equal to the suction pressure in the mentioned space and formed by the wraps of the two scroll members, which is disclosed in Japanese Patent Laid-open No. 148994/1980 and the corresponding U.S. Pat. No. 4,365,941.

The closed space on the rear side of the end plate of the orbiting scroll member and the working chamber being in compression stroke are communicated with each other via small ports formed in the end plate of the orbiting scroll member, thereby to maintain the pressure in the space at a level between the levels of the suction pressure and the discharge pressure. Consequently, the orbiting scroll member is pressed from the rear surface thereof, so that it closely contacts with the stationary scroll member (U.S. Pat. Nos. 4,365,941 and 4,475,874).

Another conventional scroll compressor is constructed so that the whole of the axial thrust applied to an orbiting scroll member is supported by a thrust bearing provided on the rear surface of an end plate of the orbiting scroll member. In this scroll compressor, the axial thrust is lessened by using a fluid pressure (Japanese Patent Laid-open No. 148087/1982 and the corresponding U.S. Pat. No. 4,065,279).

In these conventional techniques, it is necessary to provide seal portions on the outer side of the wraps of the two scroll members. Therefore, the outer diameters of the scroll members and the weight of the orbiting scroll member increase. This causes the centrifugal load during a high speed operation of the scroll compressor to excessively increase.

SUMMARY OF THE INVENTION

An object of the present invention is to provide a scroll compressor having scroll members of a small outer diameter, and capable of maintaining the opposed axial end surfaces of orbiting and stationary scroll members in excellently-sealed state.

Another object of the present invention is to provide a scroll compressor in which a working chamber, the internal pressure of which is equal to a suction pressure, and a space on the rear surface of an end plate of an orbiting scroll member are sealed via a seal element provided between the rear surface of the end plate of the orbiting scroll member and a stationary member.

The characteristics of the present invention reside in a scroll compressor having an orbiting scroll member formed by setting a volute wrap perpendicularly on an end plate, a stationary scroll member formed to substantially the same shape as the orbiting scroll member, and a working chamber formed by meshing the wraps of the stationary and orbiting scroll members with each other in opposed state, the orbiting scroll member being orbited with respect to the stationary scroll member so that the orbiting scroll member is not rotated, to suck a fluid from a suction chamber, which is provided on the outer side of the working chamber, into the working chamber and compress the same therein, the resultant fluid being discharged to the outside, a seal means for pressure sealing a space, which is formed on the rear surface of the end plate of the orbiting scroll member, and the suction chamber being provided on the rear surface of the end plate of the orbiting scroll member, small-diameter ports for communicating the mentioned space and the working chamber with each other being provided in the end plate of the orbiting scroll member.

BRIEF DESCRIPTION OF THE DRAWINGS

The accompanying drawings show an embodiment of the present invention, wherein.

DESCRIPTION OF THE PREFERRED EMBODIMENT

Figure 1:
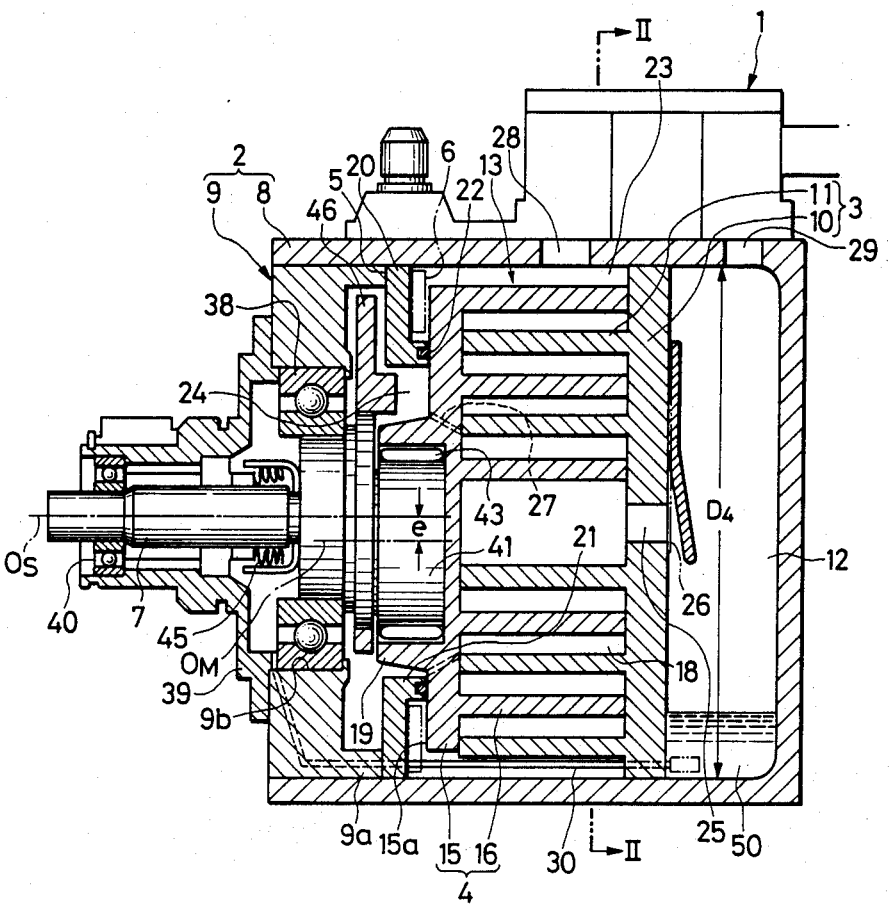
FIG. 1 is a longitudinal section of the scroll compressor.
Figure 2:
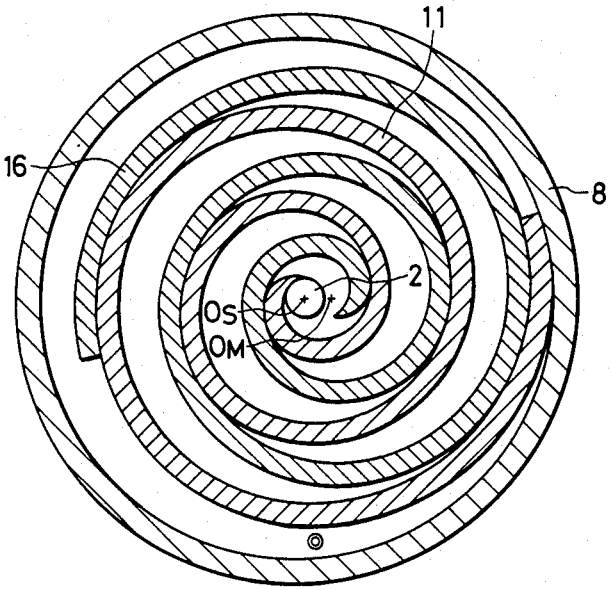
FIG. 2 is a sectional view taken along the line II—II in FIG. 1.

FIG. 1 shows a scroll compressor 1 used as a compressor for an automotive air conditioner. The compressor comprises a casing 2, a stationary scroll member 3, an orbiting scroll member 4, a seal means 5, a self-revolution-preventing means 6 for the orbiting scroll member, and a crankshaft 7.

The casing 2 consists of a top-side-opened cup-shaped housing 8, and a ring-shaped frame 9 press-fitted in the opened portion of the housing 8. The frame 9 is provided on the outer circumferential surface thereof with an inwardly-extending ring shaped projection 9*a* of a small width.

The stationary scroll member 3 consists of a disc type end plate 10, and a spiral wrap 11 formed on the end plate 10 so as to extend perpendicularly therefrom. The outer circumferential surface of the end plate 10 is fixed to the inner circumferential surface of the housing 8, this end plate 10 dividing the interior of the casing 2 into a bottom-side discharge chamber 12 and a top-side space 13.

The orbiting scroll member 4 is provided in the space 13, and consists of a disc type end plate 15 and a spiral wrap 16 formed on the end plate 15 so as to extend perpendicularly therefrom. This wrap 16 and the wrap of the stationary scroll member are formed in the same shape. The stationary and orbiting scroll members 3, 4 are combined with each other with their wraps 11, 16 opposed to each other, and a working chamber 18 consisting of a sealed space are formed by these wraps 11, 16. The surface (which will hereinafter be referred to as a rear surface) 15*a* of the end plate 15 which is on the opposite side of the wrap 16 is provided with a ring-shaped boss 19 the axis $O_M$ of which deviates from that $O_S$ of the end plate 10 in the stationary scroll member 3 by a distance e in the radial direction thereof.

A ring type seat 20 which constitutes a stationary member and which is a constituent element of the seal means 5 is fixed to the inner circumferential surface of the housing 8, and one side surface of the seat 20 is in close contact with the projection 9*a* of the frame 9. An annular groove 21*a* is formed in a projection 21 made like a ring of a small width on the inner peripheral surface of the seat 20, and a seal ring 22 is fitted in this groove 21*a* as shown in FIG. 3, a space between the rear surface 15*a* of the end plate 15 of the orbiting scroll member 4 and the seat 20 being sealed by the seal ring 22.

The sealed space 13 defined by the housing 8, frame 9, stationary scroll member 3 and orbiting scroll member 4 is separated by the seat 20 into a suction chamber 23 on the outer side thereof and a back pressure chamber 24 on the inner side thereof.

Figure 3:
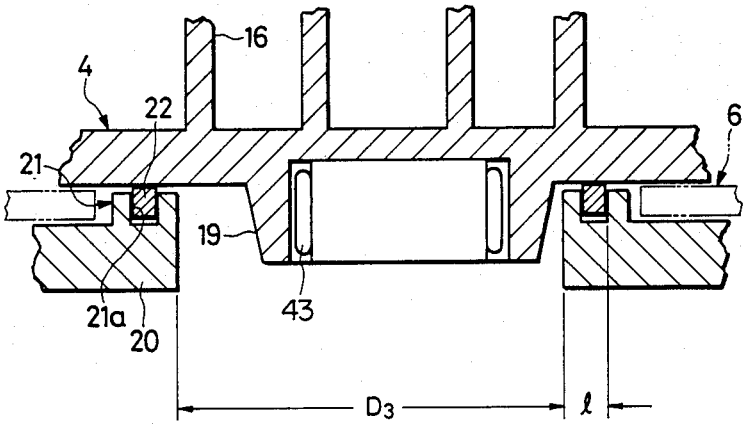
FIG. 3 is a sectional view of a seal means.

A distance l, which is shown in FIG. 3, between the inner surface of the inner wall of the seat 20 and the outer surface of the outer wall of the groove 21*a*, in which the seal ring 22 is inserted, is set smaller than a stroke (diameter 2*e* of an orbiting movement) of a motion of the orbiting scroll member 4.

The end plate 10 of the stationary scroll member 3 is provided with a discharge port 25 which is communicated with the working chamber 18 and discharge chamber 12, and one open end of the discharge port 25 is covered with a discharge valve 26 attached to the end plate 10. The end plate 15 of the orbiting scroll member 4 is provided with a pair of small-diameter ports 27 which are communicated with the working chamber 18 and back pressure chamber 24. These small-diameter ports 27 are positioned symmetrically with respect to a point which is halfway between the above-mentioned axes $O_S$, $O_M$.

The circumferential wall of the housing 8 is provided with a suction port 28, which is communicated with the suction chamber 23 and joined to an external refrigerating cycle, and a discharge port 29, which is communicated with the discharge chamber 12. The port in the stationary scroll member 3, a pipe provided between the stationary and orbiting scroll members 3, 4 and the ports in the seat 20 and frame 9 form an oil supply passage 30 which communicates the discharge chamber 12 and the inner circumferential surface 9*b* of the frame 9 with each other.

Figure 4:
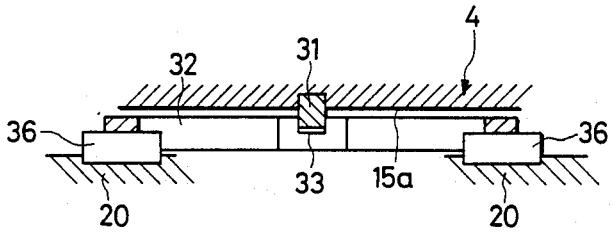
FIG. 4 is a sectional view of a self-revolution-preventing means.
Figure 5:
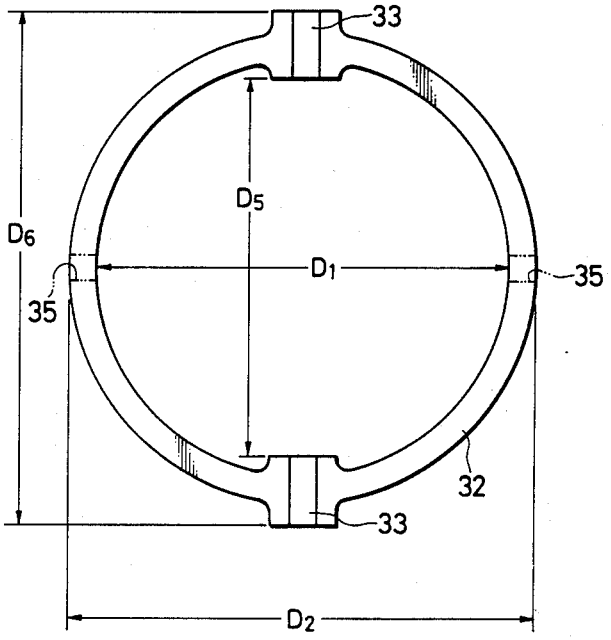
FIG. 5 is a plan view of a ring member.

The details of the self-revolution-preventing means 6 will now be described with reference to FIGS. 4 and 5. A pair of key members 31 or key portions formed integrally with the end plate 15 of the orbiting scroll member 4 are provided in opposed state in the portions of the rear surface 15*a* of the end plate 15 which are spaced 180°. These key members 31 or key portions are inserted in or formed on a pair of first key ways 33 or parts made or located in opposed state in the positions on the ring member 32 which are spaced 180°. The ring member 32 is further provided with a pair of second key ways 35 which extend at right angles to the first key ways 33, and a pair of key members 36 provided in opposed state in the portions of the seat 20 which are spaced 180° are inserted in these key ways 35.

The axis of the crankshaft 7 is aligned with that of the stationary scroll member 3, and the intermediate portion of the crankshaft is supported pivotably on a bearing 38 press-fitted in the inner circumferential surface 9*b* of the frame 9, one end portion of the crankshaft 7 being supported on a bearing 40 press-fitted in a sleeve 39 fixed to the top surface of the frame 9. The crankshaft 7 is provided at the other end portion thereof with an eccentric shaft portion 41 which deviates from the axis of the crankshaft in the radial direction by a distance e. This eccentric shaft portion 41 is supported on the boss 19 of the orbiting scroll member 4 via a bearing 43.

A pulley (not shown) is attached via a bearing on, and an electromagnet (now shown) is fixed to, the outer circumferential surface of the free end portion of the sleeve 39. The sleeve 39 is provided therein with a mechanical seal member 45 for sealing the crankshaft 7.

An armature plate is supported resiliently on the end portion of the crankshaft 7 which projects from the sleeve 39. The pulley, electromagnet and armature plate form an electromagnetic clutch. Owing to this arrangement, the rotation of an external driving power source, for example, an automobile engine is transmitted to the pulley via a belt, and the electromagnet is turned on to cause the armature plate to be attracted to the pulley, the rotational force being thereby transmitted to the crankshaft 7.

Referring to FIG. 1, reference numeral 46 denotes a balance weight mounted on the crankshaft 7.

The operation of the embodiment of the present invention will now be described.

When the crankshaft 7 is rotated owing to the operation of the electromagnetic clutch, the eccentric shaft portion 41 is orbited while rotating, and the orbiting movement moves the orbiting scroll member 4 to cause the ring member 32 to be moved reciprocatingly on the key members 36, and the key members 31 to be moved reciprocatingly in the key ways 33 in the ring member 32, whereby the self-revolution of the orbiting scroll member 4 is prevented. The fluid introduced from the suction port 28 into the suction chamber 23 flows into the working chamber 18 owing to the cooperation of the stationary and orbiting scroll members 3, 4. The fluid is then moved to the central portion of the working chamber as it is compressed by the wraps 11, 16 based on the orbiting movement of the orbiting scroll member 4, and flows from the discharge port 25 of the stationary scroll member 3 into the discharge chamber 12 as the fluid raises the discharge valve 26.

The lubricating oil contained in this discharged fluid is separated therefrom in the discharge chamber 12, and the resultant fluid is discharged from the discharge port 29 into an external pipe.

During this time, the pressure in the back pressure chamber 24 reaches a level which is intermediate between the levels of the suction pressure and discharge pressure in accordance with the pressure in the working chamber 18 due to the small-diameter ports 27 communicated with the working chamber 18 which is in a compression operation. When the force due to the pressure applied to the rear surface 15*a* of the orbiting scroll member 4 is larger than the axial thrust applied from the working chamber 18 to the orbiting scroll member 4, the orbiting scroll member 4 is pressed from the rear surface 15*a* to closely contact the stationary scroll member 3. When the force due to the pressure applied to the rear surface 15*a* of the orbiting scroll member 4 is smaller than this axial thrust, the seat 20 works as a thrust bearing, and the thrust is lessened by the force applied to the rear surface 15*a*, , so that the slide loss of the thrust bearing can be reduced.

The lubricating oil 50 collected in the bottom portion of the discharge chamber 12 is sent to the inner circumferential surface 9*b* of the frame 9 through the oil supply passage 30 to lubricate the bearing 38. This oil then lubricates the mechanical seal member 45 and bearing 43, and is sent to the working chamber 18 through the small-diameter ports 27 in the orbiting scroll member 4. The resultant oil is used to seal the space between the wraps 11, 16 in the working chamber 18, and then discharged with the working fluid into the discharge chamber 12. The oil is then separated from the fluid and collected in the bottom portion of the discharge chamber 12.

The operation of the self-revolution-preventing means 6 will now be described in detail. Let $D_1$, $D_2$, $D_3$, $D_4$ equal a distance between the inner ends of the ring member 32 which are in the direction of the reciprocating movement thereof, a distance between the outer ends of the ring member 32 which correspond to these inner ends thereof, a distance between the diametrically opposite portions of the outer surface of the projection 21 of the seat 20 (FIG. 3) and a distance between the diametrically opposite portions of the inner circumferential surface of the housing 8 (FIG. 1), respectively. These distances have the following relation.

$$D_1 > D_3 + 2e,\ D_2 < D_4 - 2e$$

Let $D_5$ and $D_6$ equal a distance between the inner ends of the ring member 32 in the direction of the reciprocating movement of the key members 31, and a distance between the outer ends of the ring member 32 which correspond to these inner ends thereof, respectively. These distances have the following relation.

$$D_5 > D_3$$

$$D_4 > D_6 > D_5 + 2e$$

Namely, the key way 33 is not less than two times as long as the radius e of the orbiting movement of the orbiting scroll member 4.

In general, the distance between the centers of the key ways 33 and that between the centers of the key ways 35 in the ring member 32 have the following relation.

$$\tfrac{1}{2}(D_1 + D_2) \div \tfrac{1}{2}(D_5 + D_6)$$

The combination of the key ways 35 and key members 36 may also consist of key members provided on the ring member 32, and key ways provided in the seat 20.

If the self-revolution-preventing means 6, in which these dimensional requirements are met, is provided on the outer side of the seat 20 with the distance $D_4$ restricted, the distance $D_3$ in the seat 20 can be set to the highest level, and a bearing 38 having a large outer diameter and a high load capacity can be provided in the through hollow in the boss 19. Since the diameter of the seal ring 22 can also be increased, the pressure-receiving area can be increased, and the level of the force applied to the rear surface 15*a* of the end plate of the orbiting scroll member 4 can be lowered.

Referring to FIG. 3, the distance l between the inner surface of the inner wall of the seat 20 and the outer surface of the outer wall of the groove 21*a* is set shorter than the stroke (=2e) of the orbiting scroll member 4, and the lubricating oil sent to the back pressure chamber 24, vaporized and deposited on the rear surface 15*a* of the end plate of the orbiting scroll member 4 is supplied constantly to the seal ring 22 and the corresponding slide surface portion of the rear surface 15*a* of the same end plate. Therefore, no special means for supplying lubricating oil to the seal means 5 is required.

Figure 6:
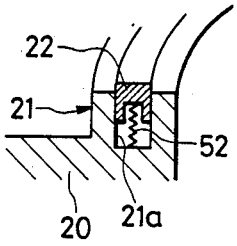
FIGS. 6 and 7 are partially perspective views of other examples of the seal means.
Figure 7:
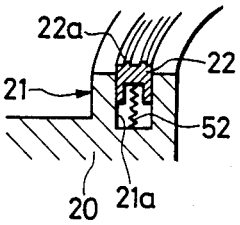

FIG. 6 shows another example of the seal means 5, which is constructed so that a seal ring 22 is pressed against the rear surface 15*a* of the end plate of the orbiting scroll member 4 by a compression spring 52 provided in the groove 21*a* formed in the projection 21. This enables a sealing operation to be carried out more reliably. FIG. 7 shows still another example of the seal means 5, in which projections 22*a* are provided on the contact surface of the seal ring 22, these projections enabling the sealing to be done more reliably.

Figure 8:
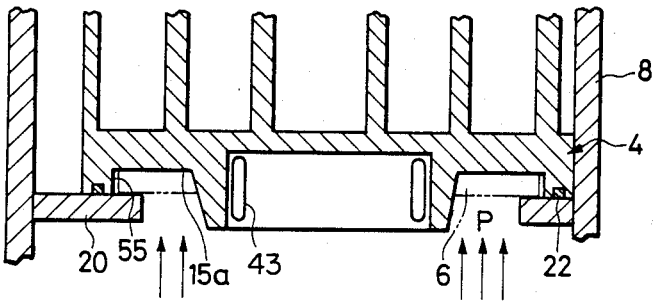
FIG. 8 is a longitudinal section of other examples of the seal means and self-revolution-preventing means.

FIG. 8 shows further examples of the seal means 5 and self-revolution-preventing means 6, in which a ring type projection 55 in which a seal ring 22 is fitted is provided on the outer edge portion of the rear surface 15*a* of the end plate of the orbiting scroll member 4 with a self-revolution-preventing means 6 provided on the inner side of the seal ring 22. In this case, the area to which the intermediate pressure P increases as compared with that in the embodiment of FIG. 1, so that a setting pressure can be reduced.

According to the present invention described above, the working chamber and back pressure chamber are communicated with each other via small diameter ports, and the pressure-sealing of these chambers can be done at the rear surface of the end plate of the orbiting scroll member. Accordingly, it becomes unnecessary to provide a seal portion on the outer side of the wraps, so that the compression system can be miniaturized. This enables the dimensions and weight of the compressor as a whole to be reduced. Since the dimensions and weight of the orbiting scroll member are reduced, the centrifugal load decreases and this scroll member can be orbited at a higher speed.

What is claimed is:

1. A scroll compressor comprising a orbiting scroll member having an end plate with a boss for receiving a shaft at a central portion thereof and a spiral wrap formed perpendicularly on said end plate, a stationary scroll member provided with a wrap meshable with the wrap of said orbiting scroll member, a housing means having an axially extending wall portion and a radially extending frame portion for enclosing said oribiting and stationary scroll members and defining a backside space by said orbiting scroll end plate, said axially extending wall portion and said radially extending frame portion, on the orbiting scroll end plate side, and a working chamber formed by opposingly meshing the wraps of said stationary and orbiting scroll members with each other said orbiting scroll member being orbited with respect to said stationary scroll member so that said orbiting scroll member is not self-revolved, to suck a fluid from a suction chamber, which is provided on the outer side of said working chamber, into said working chamber and compress the same therein, the resultant fluid being discharged to the outside, wherein said suction chamber is defined by outer surfaces of said spiral wraps meshed with each other, said axially extending wall portion of said housing means which directly faces said outer surface of said meshed spiral wraps, and a ring-shaped seat member disposed in said backside space between said end plate of said oribiting scroll member and said radially extending frame portion so as to provide a space between said end plate of said orbiting scroll member and said ring-shaped seat member, said ring-shaped seat member having an outer peripheral portion sealingly mounted on said housing means and an inner peripheral portion extending toward said boss, a sealing means is disposed in a circumferential region of said boss between said ring-shaped seat member and said end plate of said orbiting scroll member for fluidly separating said suction chamber from said backside space to close said backside space, and a small-diameter port for communicating said closed backside space and said working chamber with each other are provided in the end plate of said orbiting scroll member.

2. A scroll compressor according to claim 1, wherein said sealing means comprises projection formed in said seat member and provided with an annular groove therein, and a seal ring fitted in said groove.

3. A scroll compressor according to claim 1, wherein means for preventing self-revolution of the orbiting scroll member is provided between said end plate of said orbiting scroll member and said seat member on the outer circumferential side of said sealing means.

4. A scroll compressor according to claim 1, wherein said sealing means includes a projection provided on the outer edge portion of the rear surface of said end plate of said orbiting scroll member, and means for preventing self-revolution of the orbiting scroll member is provided between said end plate of said orbiting scroll member and said seat member on the inner circumferential side of said sealing means.

5. A scroll compressor according to claim 1, wherein said seat member includes an annular projection provided with an annular groove therein, a seal ring inserted in said groove, and a compression spring for urging said seal ring.

6. A scroll compressor comprising an orbiting scroll member having an end plate and a spiral wrap thereon, a stationary scroll member having an end plate and a wrap thereon and meshable with said wrap of said oribiting scroll member, and a plurality of mutually-sealed working chambers formed by opposingly meshing said wraps of said scroll members, said orbiting scroll member being orbited with respect to said stationary scroll member without self-revolving the former, to suck a gas from the suction side of said working chambers thereinto via a suction port and compress the same therein, the resultant gas being discharged from said working chambers via a discharge port, a suction chamber being defined by an axially extending wall portion of a housing means enclosing said orbiting and stationary scroll members, outer surfaces of said wraps meshed with each other and disposed so as to directly face said axially extending wall portion of said housing means, a ring-shaped seat member disposed at an orbiting scroll member end plate side of said housing means with an axial distance between said end plate of said orbiting scroll member and said seat member and extending axially inward from said axially extending wall portion of said housing means, and a sealing means provided between said seat member and said end plate of said orbiting scroll member, so as to fluidly separate said suction chamber from a space formed at a rear side region of said end plate of said oribiting scroll member, and a self-revolution-preventing mechanism being provided between said seat member and said end plate of said orbiting scroll member, wherein the end plate of said orbiting scroll member is provided with a pair of small-diameter ports for communicating said working chamber, which is formed by said two scroll members, with said space, said small-diameter ports being arranged in substantially symmetric relation with respect to the center of said end plate of said scroll member.

7. A scroll compressor according to claim 6, wherein said seal means comprises a projection formed in said seat member and provided with an annular groove therein, and a seal ring fitted in said groove.

8. A scroll compressor according to claim 6, wherein said self-revolution-preventing mechanism is provided on the outer circumferential side of said sealing means.

9. A scroll compressor according to claim 6, wherein said sealing means comprises an annular projection formed in said inner end of said seat member and provided with an annular groove therein, a seal ring inserted in said groove, and a compression spring for urging said seal ring.

10. A scroll compressor comprising an orbiting scroll member having a spiral wrap formed perpendicularly on an end plate, a stationary scroll member provided with a wrap meshable with the wrap of said orbiting scroll member, and a working chamber formed by meshing the wraps of said stationary and orbiting scroll members with each other in opposed state, said orbiting scroll member being orbited with respect to said stationary scroll member so that said orbiting scroll member is not self-revolved, to suck a fluid from a suction chamber, which is provided on the outer side of said working chamber, into said working chamber and compressed the same therein, the resultant fluid being discharged to the outside, characterized in that a means for sealing between a spaced formed on the rear surface of said end plate of orbiting scroll member and said suction chamber is provided on said rear surface of said end plate of said orbiting scroll member said seal means comprises a stationary member, an annular projection formed on the outer edge portion of the rear surface of said end plate of said orbiting scroll member and provided with an annular groove therein, a seal ring inserted in said groove, and a compression spring for urging said seal ring on said stationary member, a self-revolution-preventing means being provided on the inner circumferential side of equal ring, and a small-diameter port for communicating said space and said working chamber with each other are provided in the end plate of said orbiting scroll member.

11. A scroll compressor comprising an orbiting scroll member having a end plate and a spiral wrap thereon, a stationary scroll member having an end plate and a wrap thereon and meshable with said wrap of said orbiting scroll member, and a plurality of mutually-sealed working chambers formed by opposingly meshing said wraps of said scroll members, said orbiting scroll member being orbited with respect to said stationary scroll member without self-revolution of the orbiting scroll member to suck a gas from a suction side of said working chambers thereinto via a suction port and compress the gas therein, the compressed gas being discharged from said working chambers via a discharge port, wherein a suction chamber is defined by an axially extending wall portion of a housing means enclosing said orbiting and stationary scroll members, outer surfaces of said wraps meshed with each other and disposed so as to directly face said axially extending wall portion of said housing means, a ring-shaped seat member disposed at an orbiting scroll member end plate side of said housing means with an axial distance between said end plate of said orbiting scroll member and said seat member and extending axially inwardly from said axially extending wall portion of said housing means, and a sealing means provided between said seat member and said end plate of said oribiting scroll member for fluidly separating said suction chamber from a space formed at a rear side region of said end plate of said oribiting scroll member, and a self-revolution-preventing mechanism being provided between said seat member and said end plate of said orbiting scroll member, said self-revolution-preventing mechanism including a ring member having a first and second pair of keyways, the first pair of keyways engaging keys provided in said end plate of said orbiting scroll member and the second pair of keyways engaging keys provided in said seat member, and a distance between outer sides of said second pair of keyways being larger than a distance between outer sides of said first pair of keyways.

* * * * *